US009850895B2

(12) United States Patent
Hikichi et al.

(10) Patent No.: US 9,850,895 B2
(45) Date of Patent: Dec. 26, 2017

(54) LIQUID PUMP AND RANKINE CYCLE APPARATUS

(71) Applicant: Panasonic Corporation, Osaka (JP)

(72) Inventors: Takumi Hikichi, Osaka (JP); Osao Kido, Kyoto (JP)

(73) Assignee: PANASONIC CORPORATION, Osaka (JP)

( * ) Notice: Subject to any disclaimer, the term of this patent is extended or adjusted under 35 U.S.C. 154(b) by 115 days.

(21) Appl. No.: 14/936,726

(22) Filed: Nov. 10, 2015

(65) Prior Publication Data

US 2016/0186746 A1 Jun. 30, 2016

(30) Foreign Application Priority Data

Dec. 26, 2014 (JP) ..... 2014-264982

(51) Int. Cl.
*F04C 2/10* (2006.01)
*F01K 19/10* (2006.01)
(Continued)

(52) U.S. Cl.
CPC ..... *F04C 2/10* (2013.01); *F01K 19/10* (2013.01); *F01K 21/00* (2013.01); *F04C 2/025* (2013.01); *F04C 2/356* (2013.01); *F04C 15/008* (2013.01); *F04C 15/0088* (2013.01); *F04C 15/0096* (2013.01); *F04C 18/0215* (2013.01);
(Continued)

(58) Field of Classification Search
CPC ..... F04C 2/10; F04C 15/008; F04C 15/0096; F04C 15/0088; F01K 19/10; F01K 21/00
See application file for complete search history.

(56) References Cited

U.S. PATENT DOCUMENTS 5,044,892 A * 9/1991 Pettitt ..... F04B 27/1009 184/6.17
5,624,243 A * 4/1997 Omodaka ..... F04C 18/023 417/366
(Continued)

FOREIGN PATENT DOCUMENTS

JP 4-012193 1/1992
JP 2977228 B2 * 11/1999
(Continued)

OTHER PUBLICATIONS

JP 2977228, Machine Translation, Translated on May 1, 2017.*
(Continued)

*Primary Examiner* — Patrick Maines
(74) *Attorney, Agent, or Firm* — McDermott Will & Emery LLP

(57) ABSTRACT

A liquid pump of the present disclosure includes a container, a shaft, a bearing, a pump mechanism, a storage space, and a liquid supply passage. The shaft is disposed in the container. The bearing supports the shaft. The pump mechanism pumps a liquid by rotation of the shaft. The storage space is defined in the container at a position outside the pump mechanism. The storage space stores the liquid to be taken into the pump mechanism or the liquid to be discharged to outside of the container after being expelled from the pump mechanism. The liquid supply passage is a flow path including an inlet open to the storage space and supplying the liquid stored in the storage space to the bearing.

7 Claims, 7 Drawing Sheets

(51) Int. Cl.

| | |
|---|---|
| ***F01K 21/00*** | (2006.01) |
| ***F04C 15/00*** | (2006.01) |
| ***F04C 23/00*** | (2006.01) |
| ***F04C 29/02*** | (2006.01) |
| ***F04C 2/02*** | (2006.01) |
| ***F04C 2/356*** | (2006.01) |
| ***F04C 18/02*** | (2006.01) |

(52) U.S. Cl.
CPC ..... *F04C 23/008* (2013.01); *F04C 29/02* (2013.01); *F04C 29/023* (2013.01); *F04C 2240/603* (2013.01); *F04C 2270/16* (2013.01)

(56) References Cited

U.S. PATENT DOCUMENTS 5,941,693 A * 8/1999 Kato ..... F04B 27/109 417/269
2004/0228744 A1 11/2004 Nakano et al.
2012/0031141 A1* 2/2012 Wada ..... F01C 1/0215 62/529
2014/0271303 A1* 9/2014 Sekiya ..... F01C 21/0836 418/55.1
2015/0308294 A1 10/2015 Honma et al.

FOREIGN PATENT DOCUMENTS

JP 2001-041175 2/2001
JP 2001041175 A * 2/2001
WO 2014/108980 7/2014

OTHER PUBLICATIONS

The Extended European Search Report dated Jun. 13, 2016 for the related European Patent Application No. 15195948.3.
Communication pursuant to Article 94(3) EPC dated Apr. 13, 2017 for the related European Patent Application No. 15195948.3.

* cited by examiner

LIQUID PUMP AND RANKINE CYCLE APPARATUS

BACKGROUND

1. Technical Field

The present disclosure relates to a liquid pump and a rankine cycle apparatus including the liquid pump.

2. Description of the Related Art

Energy systems that use natural energy sources such as sunlight or exhaust heat have attracted attention recently. One example of such energy systems is a rankine cycle system. In a typical rankine cycle system, an expander is activated by a high-temperature and high-pressure working fluid to generate electricity. The high-temperature and high-pressure working fluid is generated by a pump and a heat source (solar heat, geothermal heat, and exhaust heat from automobiles, for example). Thus, a liquid pump is used in the rankine cycle system.

As illustrated in FIG. 7, Japanese Patent No. 2977228 describes a canned refrigerant pump 300. The canned refrigerant pump 300 includes a scroll pump 320 as a positive displacement pump mechanism. The scroll pump 320 includes a fixed scroll 321 and an orbiting scroll 322. Rotational movement of the orbiting scroll 322 allows a refrigerant to be drawn through a suction pipe 333 and ejected into an ejection chamber 329. Some of the refrigerant in the ejection chamber 329 flows through a first groove 348 or a second groove 349 as a lubricating refrigerant. As a result, a thrust bearing 330*a* and a surface of a bearing 309*a* are lubricated. Then, the refrigerant further flows into a space 343*a*. A major part of the refrigerant in the ejection chamber 329 flows into the space 343*a*, which is defined by a sealed case 306, through a through hole 338, a back pressure chamber 337, and a case communication hole 344. Then, the refrigerant in the space 343*a* flows into a space 343*b* through a passage 345 or a communication groove 350. The refrigerant in the space 343*b* is expelled through a discharge pipe 347.

As illustrated in FIG. 8, Japanese Unexamined Patent Application Publication No. 2001-41175 describes a liquid refrigerant pump 500. The liquid refrigerant pump 500 includes a sealed container 501, an electrical motor 502, and a positive displacement pump mechanism 503. The electrical motor 502 and the positive displacement pump mechanism 503 are disposed in the sealed container 501. The positive displacement pump mechanism 503 includes a crankshaft 504, a rolling piston 506, and a cylinder block 570 fixed to the sealed container 501. Rotary drive of the crankshaft 504 by the electrical motor 502 allows a liquid refrigerant to be drawn to the positive displacement pump mechanism 503 through a suction pipe 520 and an inlet 521 and allows the liquid refrigerant in a compressor 514 in the positive displacement pump mechanism 503 to be expelled through an outlet 523 and a discharge pipe 522. In the liquid refrigerant pump 500, the liquid refrigerant in the compressor 514 in the cylinder block 570 leaks to outside the cylinder block 570 through a groove 551. The leaked liquid refrigerant is mixed into a liquid refrigerant E stored in the sealed container 501 as a lubricant.

SUMMARY

An improvement in reliability is desired in the canned refrigerant pump 300 described in Japanese Patent No. 2977228 and in the liquid refrigerant pump 500 described in Japanese Unexamined Patent Application Publication No. 2001-41175.

One non-limiting and exemplary embodiment provides a highly reliable liquid pump.

In one general aspect, the techniques disclosed here feature a liquid pump including: a container; a shaft disposed in the container; a bearing supporting the shaft; a pump mechanism disposed in the container to pump a liquid by rotation of the shaft; a storage space defined in the container at a position outside the pump mechanism, the storage space storing the liquid to be taken into the pump mechanism or the liquid to be discharged to outside of the container after being expelled from the pump mechanism; and a liquid supply passage including an inlet open facing to the storage space and supplying at least some of the liquid stored in the storage space to the bearing.

The above-described liquid pump has high reliability.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
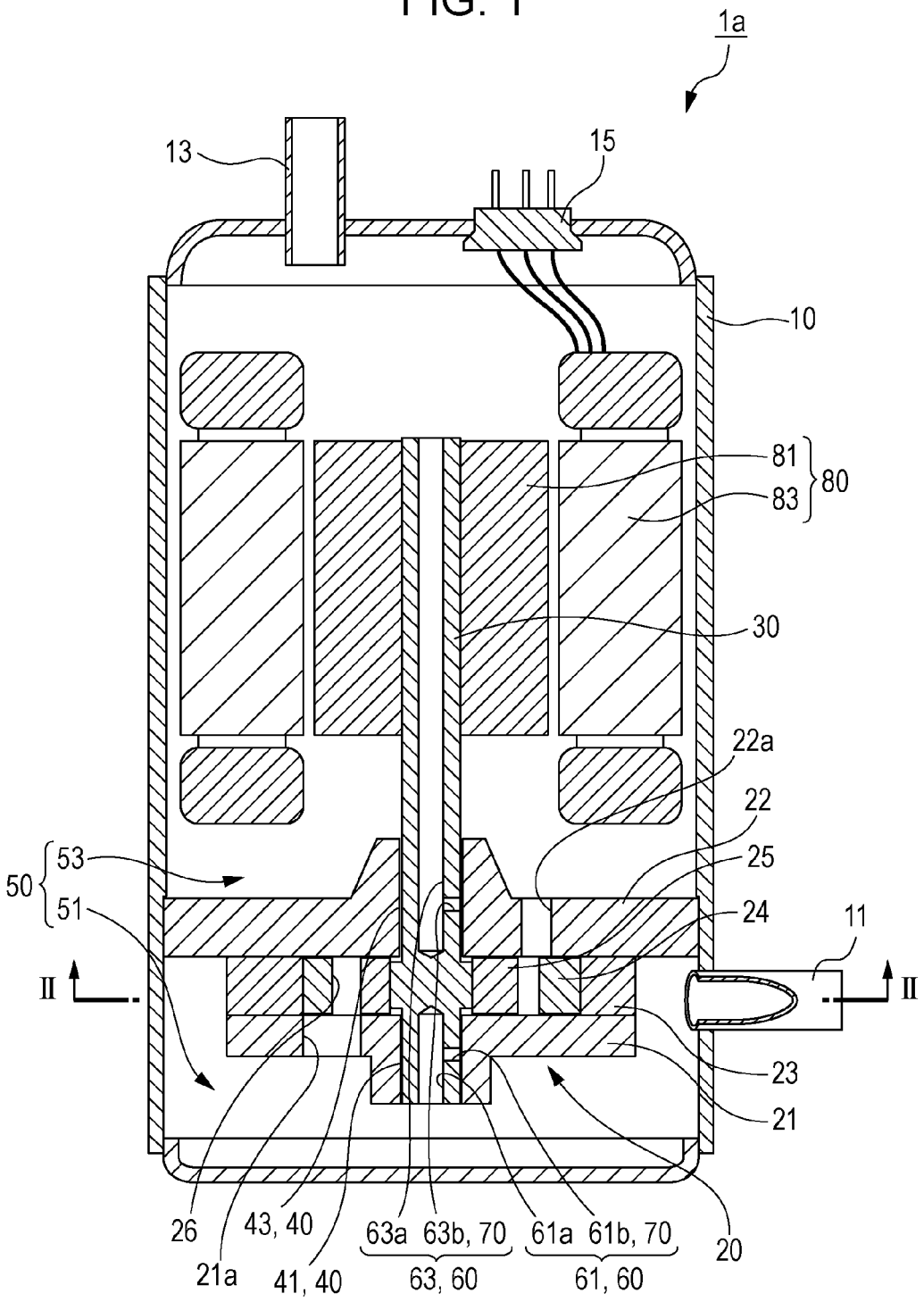
FIG. 1 is a vertical cross-sectional view illustrating a liquid pump according to an embodiment of the present disclosure.

As a liquid pump used in a rankine cycle system, for example, a positive displacement pump such as a gear pump or a rotary pump or a velocity pump such as a centrifugal pump is used in some cases. In such a liquid pump, if cavitation occurs in a liquid for lubricating a bearing, damage to the bearing may be caused. This lowers reliability of the liquid pump, leading to a decrease in pump efficiency.

Cavitation is a phenomenon in which a working fluid in liquid state in a fluid machine boils to generate microbubbles when a local pressure on the working fluid reaches a saturated vapor pressure. An impact pressure caused by bubble collapse may cause erosion in a component of the fluid machine. If such a phenomenon occurs in a bearing, the surface pressure on the bearing varies locally, which lowers the permissible load on the bearing. This may cause component wear.

In the canned refrigerant pump 300 described in Japanese Patent No. 2977228, some of the refrigerant in the ejection chamber 329 flows through the first groove 348 or the second groove 349 as a lubricating refrigerant. In the canned refrigerant pump 300, the bearing is lubricated by the refrigerant flowing in the positive displacement pump mechanism at a position upstream of the case communication hole 344 through which the refrigerant is ejected from the scroll pump 320, which is the positive displacement pump mechanism, into the space 343*a* in the sealed case 306. The first groove 348 or the second groove 349 is not exactly adjacent to a space having a sufficiently large capacity and being filled with a fluid for lubricating the bearing. In this configuration, variation in the rotation frequency of the scroll pump 320 may result in short supply of the refrigerant to the bearing. This may cause component wear. In addition, since the refrigerant in the ejection chamber 329 is in liquid state, the refrigerant to be supplied to the bearing has a large pressure pulsation. This results in variations in the permissible load on the bearing, which may cause component wear, and results in an increase in friction loss, which may lower the pump efficiency.

In the liquid refrigerant pump 500 described in Japanese Unexamined Patent Application Publication No. 2001-41175, the liquid refrigerant that has leaked to the outside of the cylinder block 570 through the groove 551 is mixed into the lubricating liquid refrigerant E. However, a major part of the liquid refrigerant in the positive displacement pump mechanism 503 is expelled through the outlet 523 and the discharge pipe 522. The liquid refrigerant in the positive displacement pump mechanism 503 is not entirely stored as the lubricating liquid refrigerant E. In the configuration in which the liquid leaks to the outside of the cylinder block 570 through the groove 551, variation in the rotation frequency of the crankshaft 504 may result in short supply of the lubricating liquid refrigerant to the bearing of the crankshaft 504. This may cause component wear.

A first aspect of the present disclosure provides a liquid pump including:

- a container;
- a shaft disposed in the container;
- a bearing supporting the shaft;
- a pump mechanism disposed in the container to pump a liquid by rotation of the shaft;
- a storage space defined in the container at a position outside the pump mechanism, the storage space storing the liquid to be taken into the pump mechanism or the liquid to be discharged to outside of the container after being expelled from the pump mechanism; and
- a liquid supply passage including an inlet open facing to the storage space and supplying at least some of the liquid stored in the storage space to the bearing.

In the first aspect, the storage space stores the liquid to be taken into the pump mechanism or the liquid to be discharged to the outside of the container after being expelled from the pump mechanism, and the inlet of the liquid supply passage is open to the storage space. In this configuration, a large amount of the liquid is supplied to the storage space. In addition, since the storage space has a predetermined capacity, the pressure pulsation of the liquid is reduced and cavitation is unlikely to occur in the liquid to be supplied to the bearing. This reduces the variation in the permissible load on the bearing and prevents damage to the bearing. As a result, the liquid pump according to the first aspect has high reliability. In addition, since the container does not need to have a storage space provided especially for a liquid lubricating the bearing, the liquid pump has a simple structure. This reduces the production cost of the liquid pump.

A second aspect of the present disclosure according to the first aspect provides the liquid pump in which the storage space includes an inlet storage space for storing the liquid to be taken into the pump mechanism and an outlet storage space for storing the liquid to be discharged to the outside of the container after being expelled from the pump mechanism. In the second aspect, the capacity of the storage space in the container is large, and thus the occurrence of cavitation in the liquid to be supplied to the bearing is advantageously reduced. In addition, the pressure pulsation of each of the liquid to be taken into the pump mechanism and the liquid to be discharged to the outside of the container after being expelled from the pump mechanism is reduced. This improves the reliability of the bearing, and eventually the reliability of the liquid pump.

A third aspect of the present disclosure according to the second aspect provides the liquid pump in which the bearing includes a first bearing and a second bearing supporting the shaft at different positions in an axial direction of the shaft, and the liquid supply passage has an inlet liquid supply passage supplying at least some of the liquid stored in the inlet storage space to the first bearing and an outlet liquid supply passage supplying at least some of the liquid stored in the outlet storage space to the second bearing. In the third aspect, the inlet liquid supply passage and the outlet liquid supply passage enable the liquid to be supplied from the corresponding storage spaces to the first bearing and the second bearing. In addition, since the liquid supply passage has a simple structure, the production cost of the liquid pump is reduced.

A fourth aspect of the present disclosure according to any one of the first to third aspects provides the liquid pump in which the shaft has the liquid supply passage inside of the shaft. In the fourth aspect, the liquid supply passage is positioned close to the bearing, and thus the length of the liquid supply passage is short. This reduces pressure loss of the liquid flowing through the liquid supply passage. As a result, cavitation is unlikely to occur in the liquid supplied to the bearing.

A fifth aspect of the present disclosure according to any one of the first to fourth aspects provides the liquid pump further including a pressure boost mechanism that increases a pressure of the liquid to be supplied to the bearing through the liquid supply passage. In the fifth aspect, the liquid to be supplied to the bearing is a high-pressure liquid and the pressure is sufficiently higher than the pressure at which cavitation occurs, and thus cavitation is more unlikely to occur in the liquid supplied to the bearing.

A sixth aspect of the present disclosure according to the fifth aspect provides the liquid pump in which the pressure boost mechanism includes a flow path extending in the shaft in a radial direction of the shaft. In the sixth aspect, centrifugal force generated by the rotation of the shaft increases the pressure of the liquid flowing through the flow path extending in the radial direction of the shaft. As a result, cavitation is unlikely to occur in the liquid supplied to the bearing. In addition, the pressure boost mechanism has a simple configuration.

A seventh aspect of the present disclosure according to any one of the first to sixth aspects provides the liquid pump in which the shaft has at least one end open facing to the storage space. In the seventh aspect, the liquid that has lubricated the bearing returns to the storage space in a shorter time, because the bearing is typically positioned close to the end of the shaft. This configuration allows the liquid that has lubricated the bearing to be readily expelled from the bearing. Thus, if the liquid supplied to the bearing contains a foreign substance, the foreign substance can be readily eliminated. As a result, damage to the bearing is prevented.

An eighth aspect of the present disclosure according to any one of the first to seventh aspect provides the liquid pump further including a motor disposed in the storage space and fixed to the shaft. In the eighth aspect, loss due to the connection between the motor and the shaft is reduced, and thus pump efficiency is improved. In addition, a gap between the motor and the shaft due to the connection between the motor and the shaft is reduced, and eccentric rotation of the shaft due to misalignment between the rotation axis of the motor and the axis of the shaft is reduced. This improves the reliability of the bearing, and eventually the reliability of the liquid pump.

A ninth aspect of the present disclosure according to any one of the first to eighth aspects provides a rankine cycle apparatus including:

- the liquid pump according to any one of the first to eight aspects;
- a heater that heats a working fluid;
- an expander that expands the working fluid heated by the heater; and
- a radiator that releases heat of the working fluid expanded by the expander, wherein
- the liquid pump takes in as the liquid the working fluid flowing from the radiator in liquid state by using the pump mechanism and pumps out the liquid to the heater.

In the rankine cycle, the working fluid flowing from the radiator is preferably a supercooled liquid or a saturated liquid having the lowest degree of supercooling to improve efficiency in the rankine cycle. In such a case, the state of the working fluid changes to a gas-liquid two-phase state when the pressure of the working fluid slightly decreases or the working fluid is slightly heated. However, in the ninth aspect, cavitation does not occur in the liquid supplied to the bearing even if such a working fluid is supplied to the liquid pump. Thus, the liquid pump has high reliability even when the rankine cycle apparatus is in high-efficiency operation.

Hereinafter, an embodiment of the present disclosure is described with reference to the drawings. The following is a description of an example of the present disclosure, and the present disclosure is not limited by the description.

Liquid Pump

As illustrated in FIG. 1, a liquid pump 1*a* includes a container 10, a shaft 30, a bearing 40, a pump mechanism 20, a storage space 50, and a liquid supply passage 60. The container 10 is a pressure-resistant sealed container, for example. The shaft 30 is disposed in the container 10. The shaft 30 extends in a vertical direction when the liquid pump 1*a* is mounted on a horizontal surface, for example. The liquid pump 1*a* may be configured so as to extend in a horizontal direction when the liquid pump 1*a* is mounted on the horizontal surface. The bearing 40 supports the shaft 30. The bearing 40 is a plain bearing. The pump mechanism 20 is disposed in the container 10 so as to pump the liquid by rotation of the shaft 30. The storage space 50 is defined in the container 10 at a position outside the pump mechanism 20 and stores the liquid to be taken into the pump mechanism 20 or the liquid to be discharged to the outside of the container 10 after being expelled from the pump mechanism 20. The liquid supply passage 60 has an inlet open to the storage space 50 and allows at least some of the liquid stored in the storage space 50 to be supplied to the bearing 40 therethrough.

The storage space 50 is configured to store all the liquid passing through the liquid pump 1*a* for a predetermined time. This configuration enables an adequate amount of the liquid to be continuously supplied to the storage space 50 while the liquid pump 1*a* is in operation.

The storage space 50 may have any capacity larger than that of an internal space of the pump mechanism 20, and may be forty times, preferably one-hundred times larger than that of the internal space of the pump mechanism 20, for example. The average time the liquid takes, during the operation of the liquid pump 1*a*, to pass through the pump mechanism 20 is defined as tp, and the average time the liquid takes to pass through the storage space 50 is defined as ts. The storage space 50 preferably satisfies ts>5tp. The storage space 50 having the predetermined capacity is likely to reduce pressure pulsation caused by the liquid flowing into and out of the storage space 50. In addition, since the inlet of the liquid supply passage 60 is open to the storage space 50, the liquid having reduced pressure variation is supplied to the bearing 40. Thus, the liquid is unlikely to vary in pressure at the bearing 40 and cavitation is unlikely to occur.

The pump mechanism 20 has an inlet hole 21*a* and an outlet hole 22*a*. The inlet hole 21*a* allows the liquid to be supplied to the internal space of the pump mechanism 20 and is open to the outside of the pump mechanism 20. The outlet hole 22*a* allows the liquid to be expelled to the outside of the pump mechanism 20 and is open to the outside of the pump mechanism 20. The liquid pump 1*a* further includes a supply pipe 11 and a discharge pipe 13, for example. The supply pipe 11 and the discharge pipe 13 are each attached to the container 10 so as to extend through the wall of the container 10. The liquid pump 1*a* is a sealed pump. The internal space of the container 10 is allowed to be in communication with an external space of the container 10 only through the supply pipe 11 and the discharge pipe 13. The liquid to be taken into the pump mechanism 20 is supplied to the internal space of the container 10 through the supply pipe 11. The liquid to be discharged to the outside of the container 10 after being expelled from the pump mechanism 20 is discharged to the outside of the container 1 through the discharge pipe 13.

As illustrated in FIG. 1, the storage space 50 includes an inlet storage space 51 and an outlet storage space 53, for example. The inlet storage space 51 stores the liquid to be taken into the pump mechanism 20. The inlet hole 21*a* of the pump mechanism 20 is open to the inlet storage space 51 and the supply pipe 11 has an end open to the inlet storage space 51. The outlet storage space 53 stores the liquid to be discharged to the outside of the container 10 after being expelled from the pump mechanism 20. The outlet hole 22*a* of the pump mechanism 20 is open to the outlet storage space 53 and the discharge pipe 13 has an end open to the outlet storage space 53. Thus, the pressure of the liquid in the outlet storage space 53 is higher than that of the liquid in the inlet storage space 51.

Each of the inlet storage space 51 and the outlet storage space 53 may have any capacity larger than that of the internal space of the pump mechanism 20, and may be twenty times, preferably fifty times larger than that of the internal space of the pump mechanism 20, for example. The average time the liquid takes, during the operation of the liquid pump 1*a*, to pass through the pump mechanism 20 is defined as tp, and the average time the liquid takes to pass through each of the inlet storage space 51 and the outlet storage space 53 is defined as ts1 and ts2, respectively. The inlet storage space 51 and the outlet storage space 53 preferably satisfy ts1>2tp and ts2>2tp, respectively. The inlet storage space 51 and the outlet storage space 53 each having the predetermined capacity are likely to reduce the pressure pulsation caused by the liquid flowing into and out of the inlet storage space 51 and the outlet storage space 53. In addition, most of the internal space of the pump mechanism 20 can be used as the storage space 50.

As illustrated in FIG. 1, the bearing 40 includes a first bearing 41 and a second bearing 43. The first bearing 41 and the second bearing 43 support the shaft 30 at different axial positions of the shaft 30. The first bearing 41 and the second bearing 43 are disposed adjacent to the inlet storage space 51 and the outlet storage space 53, respectively, for example. In such a case, the liquid supply passage 60 includes an inlet liquid supply passage 61 and an outlet liquid supply passage 63. The inlet liquid supply passage 61 is a flow path through which at least some of the liquid stored in the inlet storage space 51 is supplied to the first bearing 41 and has an inlet open to the inlet storage space 51. The outlet liquid supply passage 63 is a flow path through which at least some of the liquid stored in the outlet storage space 53 is supplied to the second bearing 43 and has an inlet open to the outlet storage space 53. This configuration enables the liquid to be supplied from the corresponding storage spaces to the first bearing 41 and the second bearing 43. In addition, the configuration of the liquid supply channel 60 is simple.

The pump mechanism 20 is an internal gear pump, for example. The pump mechanism 20 may be any gear pump other than the internal gear pump, and may be a piston pump, a vane pump, a rotary pump, a positive displacement pump such as a scroll pump, a velocity pump such as a centrifugal pump, a mixed flow pump, or an axial flow pump, or a screw pump. As illustrated in FIG. 1, the pump mechanism 20 includes a lower bearing member 21, an upper bearing member 22, a pump case 23, an outer gear 24, and an inner gear 25, for example. The lower bearing member 21 and the upper bearing member 22 are plate-shaped members. The lower bearing member 21 and the upper bearing member 22 support the shaft 30 in a rotatable manner. A portion of the lower bearing member 21 that faces the shaft 30 functions as the first bearing 41 and a portion of the upper bearing member 22 that faces the shaft 30 functions as the second bearing 43, for example. The shaft 30 extends through the center of each of the lower bearing member 21 and the upper bearing member 22. The inlet hole 21*a* and the outlet hole 22*a* extend through the lower bearing member 21 and the upper bearing member 22, respectively, in the thickness direction thereof.

Figure 2:
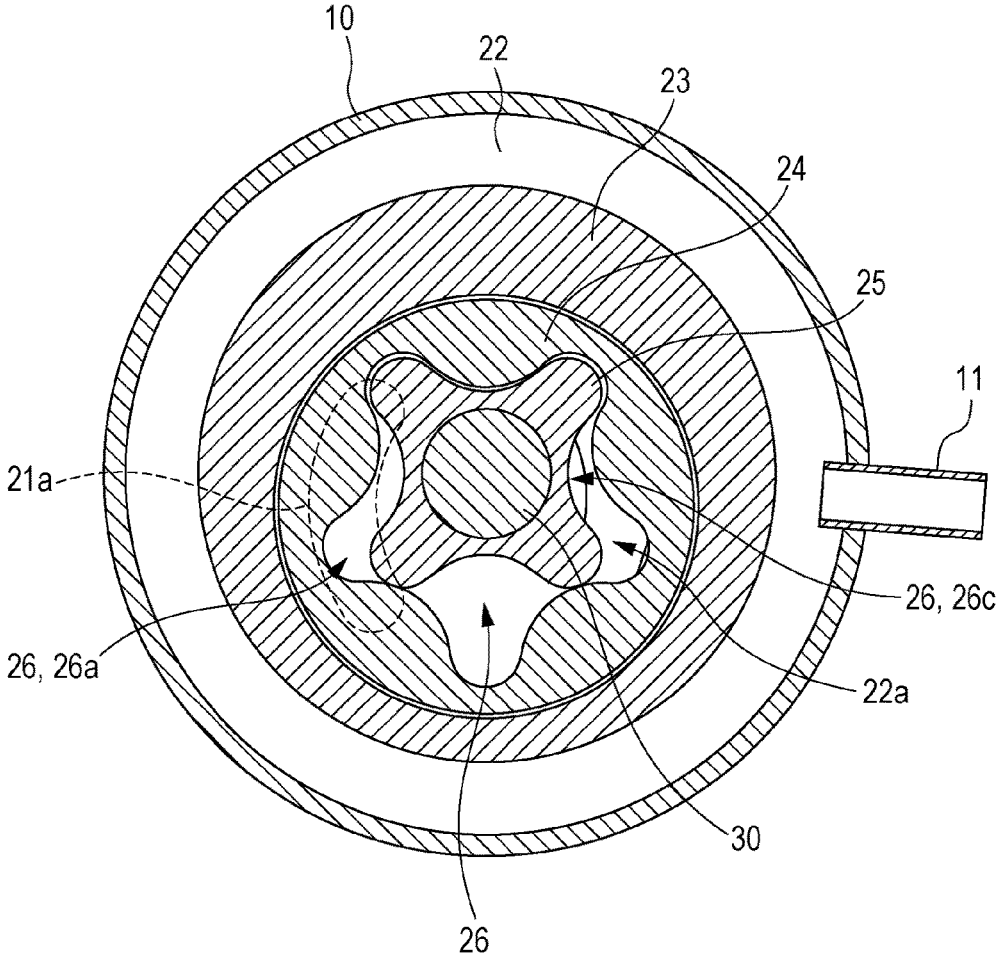
FIG. 2 is a transverse cross-sectional view illustrating the liquid pump taken along a line II-II in FIG. 1.

The pump case 23, the outer gear 24, and the inner gear 25 are sandwiched between the lower bearing member 21 and the upper bearing member 22. As illustrated in FIG. 2, the outer gear 24 and the inner gear 25 are disposed in the pump case 23. The outer gear 24 surrounds the inner gear 25. Teeth of the outer gear 24 are meshed with teeth of the outer gear 25. The inner gear 25 is fixed to the shaft 30. Thus, the rotation of the shaft 30 rotates the inner gear 25. The rotation axis of the inner gear 25 is coincident with the rotation axis of the shaft 30. The rotation axis of the outer gear 24 is displaced from the rotation axis of the shaft 30. When the inner gear 25 rotates together with the shaft 30, the teeth of the inner gear 25 push the outer gear 24 so that the outer gear 24 rotates together with the inner gear 25.

In the pump mechanism 20, the lower bearing member 21, the upper bearing member 22, the outer gear 24, and the inner gear 25 define an operation chamber 26. The rotation of the outer gear 24 and the inner gear 25 with the shaft 30 allows the pump mechanism 20 to repeatedly perform an inlet process and an output process. In other words, the rotation of the outer gear 24 and the inner gear 25 shifts a state of the operation chamber 26 from an inlet chamber 26*a* to an outlet chamber 26*c* or from the outlet chamber 26*c* to the inlet chamber 26*a*. The inlet chamber 26*a* is a space of the operation chamber 26 and is in communication with the inlet hole 21*a*. The outlet chamber 26*c* is a space of the operation chamber 26 and is in communication with the outlet hole 22*a*. The capacity of the inlet chamber 26*a* increases as the shaft 30 rotates in the inlet process, and the inlet process terminates at the end of the communication between the inlet chamber 26*a* and the inlet hole 21*a*. Further rotation of the shaft 30 allows the operation chamber 26 after the inlet process to be in communication with the outlet hole 22*a*, which shifts the state of the operation chamber 26 to the outlet chamber 26*c*. The capacity of the outlet chamber 26*c* decreases as the shaft 30 rotates. The outlet process terminates at the end of the communication between the outlet chamber 26*c* and the outlet hole 22*a*. Due to the rotation of the shaft 30, the liquid is taken into the pump mechanism 20 through the inlet hole 21*a* and expelled from the pump mechanism 20 through the outlet hole 22*a*.

The pump mechanism 20 is fixed to the container 10 by an outer end portion of the upper bearing member 22 welded to an inner surface of the container 10, for example. The upper bearing member 22 divides the internal space of the container 10 into the inlet storage space 51 and the outlet storage space 53. The supply pipe 11 is attached to the container 10 at a position below the upper bearing member 22, which is a side adjacent to the inlet hole 21*a*, and the discharge pipe 13 is attached to the container 10 at a position above the upper bearing member 22. The pump mechanism 20 may be fixed to the container 10 by an outer end portion of the lower bearing member 21 or an outer end portion of the pump case 23 welded to the inner surface of the container 10. In such a case, the internal space of the container 10 is divided into the inlet storage space 51 and the outlet storage space 53 by the lower bearing member 21 or the pump case 23. The inner surface of the container 10 defines only the storage space 50. Specifically, the inner surface of the container 10 defines only the inlet storage space 51 and the outlet storage space 53, for example.

As illustrated in FIG. 1, the liquid supply passage 60 extends in the shaft 30, for example. The inlet liquid supply passage 61 includes a main channel 61*a* and an auxiliary channel 61*b*, for example. The main channel 61*a* extends in the shaft 30 from the end of the shaft 30, which is open to the inlet storage space 51, in the axial direction of the shaft 30. The auxiliary channel 61*b* extends from the main channel 61*a* in a radial direction of the shaft 30 so as to be in communication with a space between the shaft 30 and the first bearing 41. The outlet liquid supply passage 63 includes a main channel 63*a* and an auxiliary channel 63*b*, for example. The main channel 63*a* extends in the shaft 30 from the end of the shaft 30, which is open to the outlet storage space 53, in the axial direction of the shaft 30. The auxiliary channel 63*b* extends from the main channel 63*a* in the radial direction of the shaft 30 so as to be in communication with a space between the shaft 30 and the second bearing 43. This configuration enables the liquid stored in the inlet storage space 51 to be supplied to the first bearing 41 through the internal space of the shaft 30 and the liquid stored in the outlet storage space 53 to be supplied to the second bearing 43 through the internal space of the shaft 30. As a result, the first bearing 41 and the second bearing 43 are lubricated by the liquid.

Since the liquid supply passage 60 extends in the shaft 30, the liquid supply passage 60 is positioned close to the bearing 40, and thus the length of the liquid supply passage 60 is short. This reduces pressure loss of the liquid flowing in the liquid supply passage 60. As a result, cavitation is unlikely to occur in the liquid supplied to the bearing 40. This advantage is more likely to be obtained when the bearing 40 supports the shaft 30 at a portion close to the end of the shaft 30. In addition, the shaft 30 is efficiently cooled by the liquid flowing through the liquid supply passage 60. The liquid supply passage 60 is not particularly limited and may be any flow path for supplying the liquid stored in the storage space 50 to the bearing 40. The liquid supply passage 60 may be a spiral groove on an outer surface of the shaft 30 or a groove on a bearing surface of the bearing 40.

Figure 3:
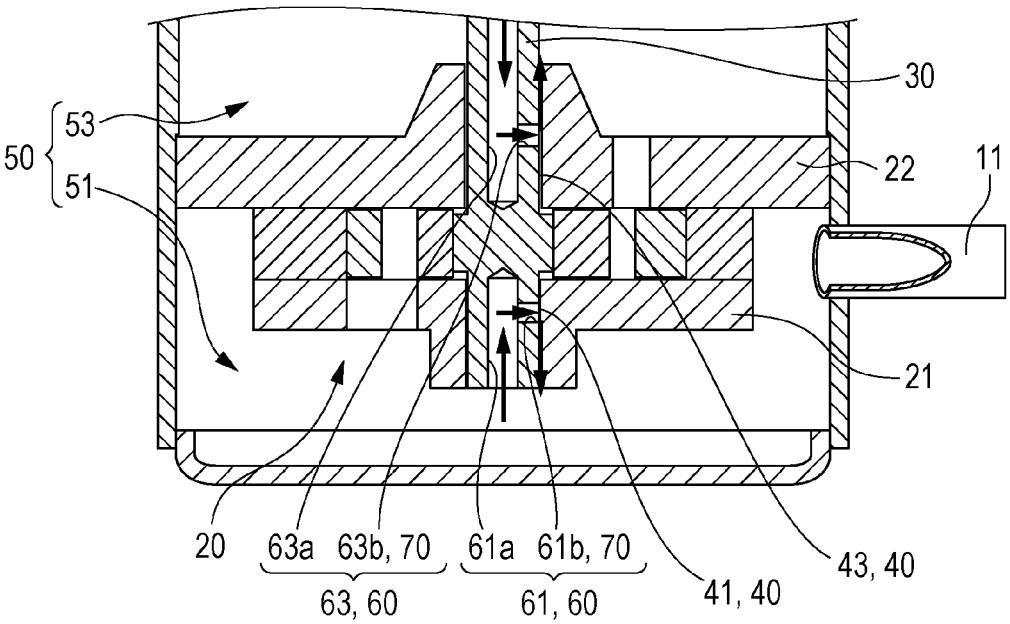
FIG. 3 is a magnified vertical cross-sectional view illustrating a portion of the liquid pump illustrated in FIG. 1.

The liquid pump 1*a* further includes a pressure boost mechanism 70, for example. The pressure boost mechanism 70 boosts the pressure of the liquid to be supplied to the bearing 40 through the liquid supply passage 60. The pressure boost mechanism 70 includes a flow path extending in the shaft 30 in the radial direction of the shaft 30, for example. As illustrated in FIG. 1, the pressure boost mechanism 70 is constituted by the auxiliary channel 61*b* of the inlet liquid supply channel 61 or the auxiliary channel 63*b* of the outlet liquid supply channel 63, for example. As illustrated in FIG. 3, the liquid is supplied to the bearing 40, for example. The rotation of the shaft 30 generates centrifugal force. The centrifugal force acts on the liquid flowing through the auxiliary channel 61*b* or the auxiliary channel 63*b* such that the liquid at the increased pressure is supplied to the first bearing 41 or the second bearing 43. The liquid to be supplied to the first bearing 41 or the second bearing 43 is a high-pressure liquid and the pressure is sufficiently higher that the pressure at which cavitation may occur. As a result, cavitation is unlikely to occur in the liquid supplied to the first bearing 41 or the second bearing 43 even if the pressure of the liquid is varied in the first bearing 41 or the second bearing 43. As a result, damage to the bearing 40 is prevented. As illustrated in FIG. 3, the liquid supplied to the first bearing 41 is expelled to the inlet storage space 51 through the space between the first bearing 41 and the shaft 30, and the liquid supplied to the second bearing 43 is expelled to the outlet storage space 53 through the space between the second bearing 43 and the shaft 30.

The pressure boost mechanism 70 is not particularly limited, and may be any mechanism that can boost the pressure of the liquid to be supplied to the bearing 40 through the liquid supply passage 60. The pressure boost mechanism 70 may be a gear pump disposed adjacent to the end of the shaft 30, for example.

As illustrated in FIG. 1, at least one of the ends of the shaft 30 is open to the storage space 50, for example. One of the ends of the shaft 30 is open to the inlet storage space 51, for example. The first bearing 41 is disposed adjacent to the end of the shaft 30. In this configuration, the liquid that has lubricated the first bearing 41 returns to the inlet storage space 51 through the short passage. This configuration allows the liquid that has lubricated the first bearing 41 to be readily expelled from the first bearing 41. Thus, if the liquid supplied to the first bearing 41 contains a foreign substance, the foreign substance can be readily eliminated. As a result, damage to the bearing is prevented.

As illustrated in FIG. 1 the liquid pump 1*a* includes a motor 80. The motor 80 is connected to the pump mechanism 20 through the shaft 30 so as to activate the pump mechanism 20. The motor 80 is disposed in the storage space 50 and is fixed to the shaft 30, for example. Specifically, the motor 80 includes a rotor 81 and a stator 83. The shaft 30 is fixed to the motor 80 with the shaft 30 being in contact with the rotor 81. In other words, the shaft 30 is directly connected to the motor 80 without a connecting member. With this configuration, the rotation axis of the motor 80 is minimally displaced with respect to the axis of the shaft 30. This reduces sliding loss between the shaft 30 and the first bearing 41 or the second bearing 43, and thus wear of each of the shaft 30, the first bearing 41, and the second bearing 43 is reduced. As a result, the liquid pump 1*a* has high reliability. The stator 83 is fixed to the inner surface of the container 10. The motor 80 is disposed in the outlet storage space 53. The liquid pump 1*a* further includes a terminal 15 for supplying electricity to the motor 80. The terminal 15 is attached to an upper portion of the container 10. When electricity is supplied to the motor 80, the shaft 30 rotates together with the rotor 81, and the pump mechanism 20 operates as described above.

Rankine Cycle Apparatus

Figure 4:
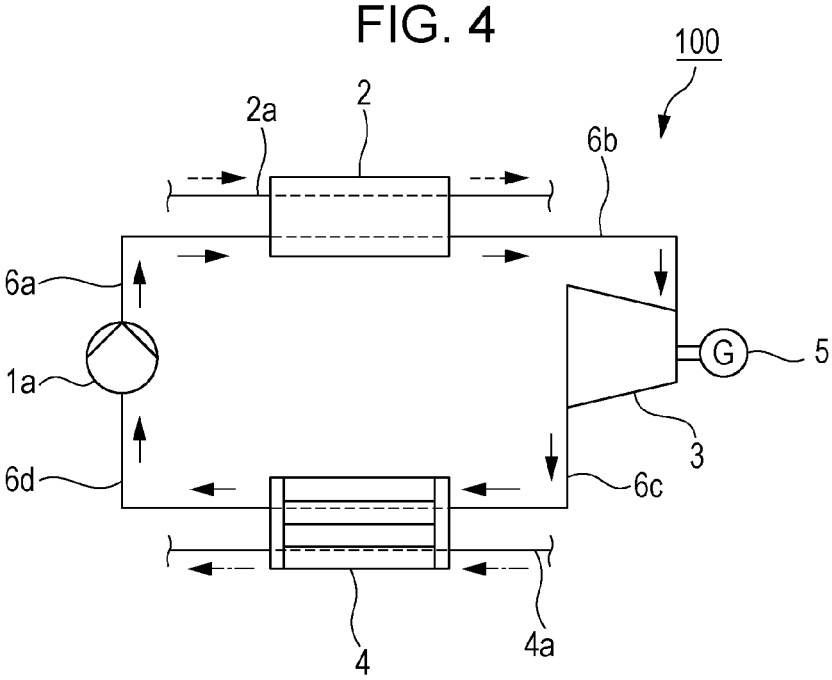
FIG. 4 is a configuration diagram of a rankine cycle apparatus according to an embodiment of the present disclosure.

A rankine cycle apparatus 100 including the liquid pump 1*a* is described. As illustrated in FIG. 4, the rankine cycle apparatus 100 includes the liquid pump 1*a*, a heater 2, an expander 3, and a radiator 4. The rankine cycle apparatus 100 has flow paths 6*a*, 6*b*, 6*c*, and 6*d* through which the liquid pump 1*a*, the heater 2, the expander 3, and the radiator 4 are connected in this order in a ring shape. The flow path 6*a* extends between an outlet of the liquid pump 1*a* and an inlet of the heater 2. The discharge pipe 13 is at least a portion of the flow path 6*a*. The flow path 6*b* extends between an outlet of the heater 2 and an inlet of the expander 3. The flow path 6*c* extends between an outlet of the expander 3 and an inlet of the radiator 4. The flow path 6*d* extends between an outlet of the radiator 4 and an inlet of the liquid pump 1*a*. The supply pipe 11 is at least a portion of the flow path 6*d*.

An organic working fluid is preferably used as the working fluid of the rankine cycle apparatus 100, for example, but the working fluid is not limited to an organic working fluid. The organic working fluid may be an organic compound such as a hydrogen halide, a carbon hydride, or an alcohol. Examples of a hydrogen halide include R-123, R365mfc, and R-245fa. Examples of a carbon hydride include propane, butane, pentane, and isopentane, which are alkanes. Examples of an alcohol include ethanol. The organic working fluid may be used alone, or two or more of the organic working fluids may be used in combination. Alternatively, the working fluid may be an inorganic working fluid such as water, carbon dioxide, or ammonia.

The heater 2 heats the working fluid in the rankine cycle. The heater 2 absorbs thermal energy from a heat medium such as geothermally heated water, combustion gas, or exhaust gas from a boiler or a furnace, and heats and evaporates the working fluid with the thermal energy. A flow path 2*a* for the heat medium is connected to the heater 2. In the case where the heat medium is a liquid such as heated water, a plate heat exchanger or a double pipe heat exchanger is preferably used as the heater 2. In the case where the heat medium is a gas such as a combustion gas or exhaust gas, a fin tube heat exchanger is preferably used as the heater 2. In FIG. 4, solid arrows each indicate a flow direction of the working fluid, and dashed arrows each indicate a flow direction of the heat medium.

The expander 3 is a fluid machine that expands the working fluid heated by the heater 2. The rankine cycle apparatus 100 further includes an electric generator 5. The electric generator 5 is connected to the expander 3. The working fluid expanded by the expander 3 provides rotational force to the expander 3. The electric generator 5 converts the rotational force to electricity. The expander 3 may be a positive displacement expander or a velocity expander. Examples of positive displacement expanders include rotary, screw, reciprocating, and scroll expanders. Examples of velocity expanders include centrifugal and axial flow expanders. The expander 3 is typically a positive displacement expander.

The radiator 4 releases heat of the working fluid expanded by the expander 3. Specifically, the heat of the working fluid is transferred to a cooling medium in the radiator 4. A flow path 4*a* for the cooling medium is connected to the radiator 4. In FIG. 4, one-dotted chain arrows each indicate a flow direction of the cooling medium. The radiator 4 may be a conventional heat exchanger, such as a plate heat exchanger, a double pipe heat exchanger, or a fin tube heat exchanger. The type of the radiator 4 is suitably determined depending on the kind of the cooling medium. In the case where the cooling medium is a liquid such as water, a plate heat exchanger or a double pipe heat exchanger is preferably used. In the case where the cooling medium is a gas such as air, a fin tube heat exchanger is preferably used.

The working fluid flowing from the radiator 4 is in liquid state. The working fluid in liquid state is expelled from the radiator 4 and introduced to the internal space of the container 10 through the supply pipe 11. The liquid pump 1*a* takes in the working fluid in liquid state, which has passed through the radiator 4, as the above-described liquid and pumps the liquid to the heater 2 by the pump mechanism 20. The working fluid is pressurized by the liquid pump 1*a*, and the pressurized working fluid is supplied to the heater 2 through the flow path 6*a*. The working fluid flowing into the liquid pump 1*a* from the radiator 4 is preferably a supercooled liquid or a saturated liquid having the lowest degree of supercooling to improve the efficiency of the rankine cycle. However, the working fluid in such a state may become a two-phase liquid due to a slight reduction in pressure or slight heating. Thus, cavitation may occur in the liquid in the bearing 40 of the liquid pump 1*a* when the pressure of the liquid in the bearing 40 is reduced or the liquid is heated. However, in the liquid pump 1*a* having the above-described configuration, cavitation is unlikely to occur in the liquid in the first bearing 41 and the second bearing 43, and thus damage to the first bearing 41 and the second bearing 43 is prevented.

In addition, since the outlet storage space 53 recovers the heat generated at the motor 80, the liquid pump 1*a* has high efficiency. As a result, the rankine cycle apparatus 100 has high efficiency.

A pressure condition and a temperature condition of the working fluid in the rankine cycle are varied depending on operation conditions of the rankine cycle apparatus. The operation conditions include a temperature of a heat medium flowing into the heater 2, the amount of heat exchanged between the working fluid and the heat medium in the heater 2, a temperature of the cooling medium flowing into the radiator 4, the amount of heat exchanged between the working fluid and the cooling medium in the radiator 4, and a rotation frequency of the expander 3. An optimum amount of the working fluid in the rankine cycle apparatus 100 is varied depending on the variation of the operation conditions of the rankine cycle apparatus 100. Since the liquid pump 1*a* can store a predetermined amount of the working fluid in the liquid state in the inlet storage space 51, for example, the liquid pump 1*a* can respond to the variation in the optimum amount of the working fluid caused by the variation in the operation conditions. Thus, the rankine cycle apparatus 100 operates with a high cycle efficiency.

Modifications

Various modifications may be added to the liquid pump 1*a*. The liquid pump 1*a* may be modified as a liquid pump 1*b* illustrated in FIG. 5, for example. The liquid pump 1*b* has the same configuration as the liquid pump 1*a* unless otherwise specified. Components of the liquid pump 1*b* that are the same as those of the liquid pump 1*a* are assigned reference numerals the same as those of the liquid pump 1*a* and detailed description thereof is omitted in some cases. The description regarding the liquid pump 1*a* is applicable to the liquid pump 1*b* if no technical contradiction occurs. The same is applicable to a liquid pump 1*c*, which is described later.

Figure 5:
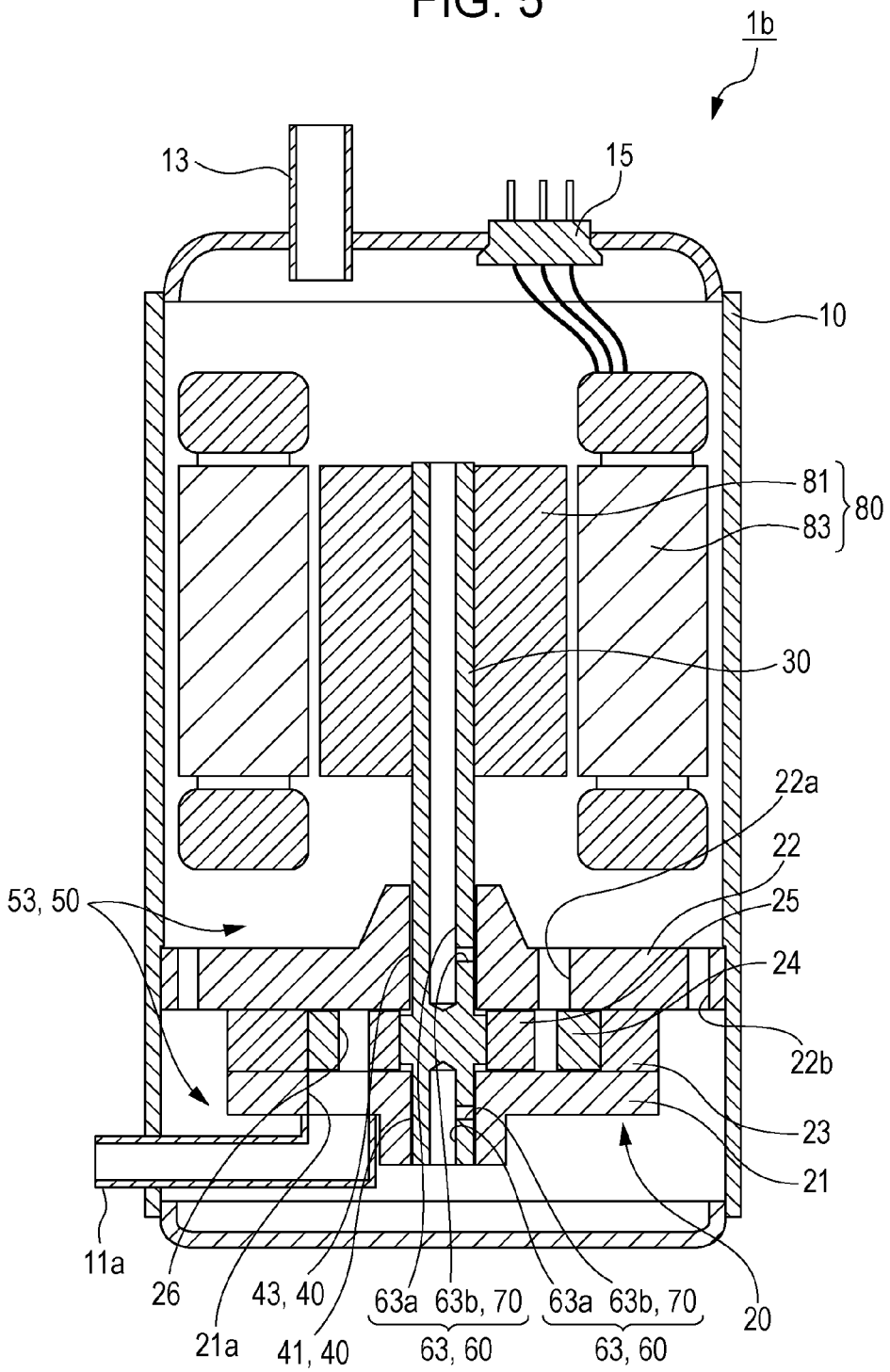
FIG. 5 is a vertical cross-sectional view illustrating a liquid pump according to a modification.

As illustrated in FIG. 5, the liquid pump 1*b* includes a supply pipe 11*a* instead of the supply pipe 11. The supply pipe 11*a* is attached to the wall of the container 10. An end of the supply pipe 11*a* is directly connected to the pump mechanism 20. In other words, an internal space of the supply pipe 11*a* is in direct communication with the internal space of the inlet hole 21*a*. This configuration enables the liquid to flow into the pump mechanism 20 through the supply pipe 11*a* without being stored in a space having a predetermined capacity.

The upper bearing member 22 has a communication hole 22*b* positioned radially outward from the pump case 23. The communication hole 22*b* extends through the upper bearing member 22. The space above the upper bearing member 22 and the space below the upper bearing member 22 are in communication with each other through the communication hole 22*b* and form the outlet storage space 53. In such a case, the inner surface of the container 10, for example, defines only the outlet storage space 53. The liquid to be discharged to the outside of the container 10 after being expelled from the pump mechanism 20 is stored not only in the space of the outlet storage space 53 positioned above the upper bearing member 22 but also in the space of the outlet storage space 53 positioned below the upper bearing member 22. Since the outlet storage space 53 has the predetermined capacity, the pressure pulsation, which may be caused by the liquid flowing from and into the outlet storage space 53, is reduced. In addition, since the inlet of the liquid supply passage 60 is open to the outlet storage space 53, the liquid having reduced pressure variation is supplied to the bearing 40. As a result, the pressure variation in the liquid is reduced in the bearing 40, and cavitation is unlikely to occur.

In the liquid pump 1*b*, the liquid supply passage 60 includes two outlet liquid supply passages 63. One of the outlet liquid supply passages 63 is a flow path through which the liquid stored in the space of the outlet storage space 53 positioned below the upper bearing member 22 is supplied to the first bearing 41, and the other is a flow path through which the liquid stored in the space of the outlet storage space 53 positioned above the upper bearing member 22 is supplied to the second bearing 43.

Figure 6:
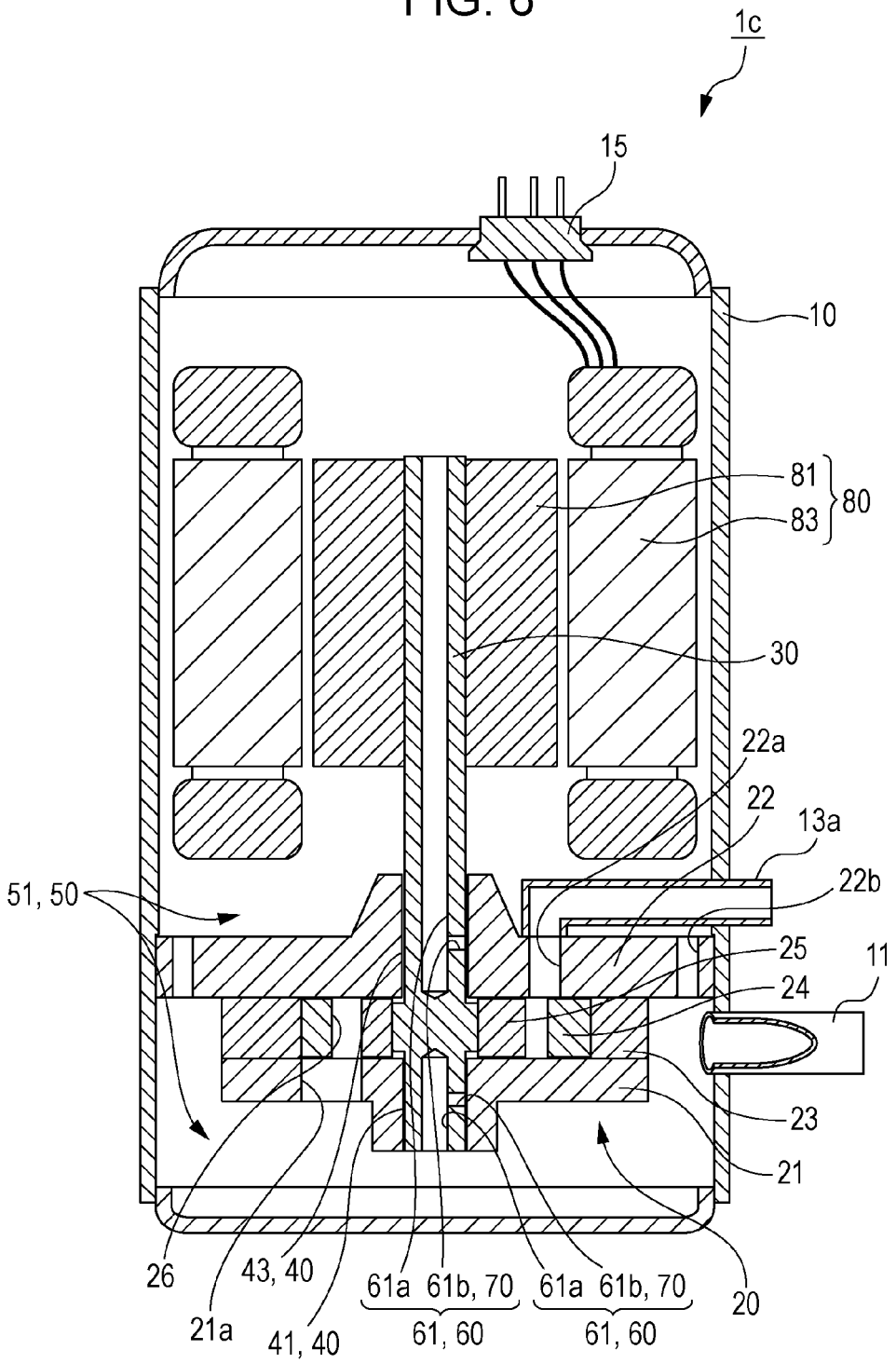
FIG. 6 is a vertical cross-sectional view illustrating a liquid pump according to another modification.
Figure 7:
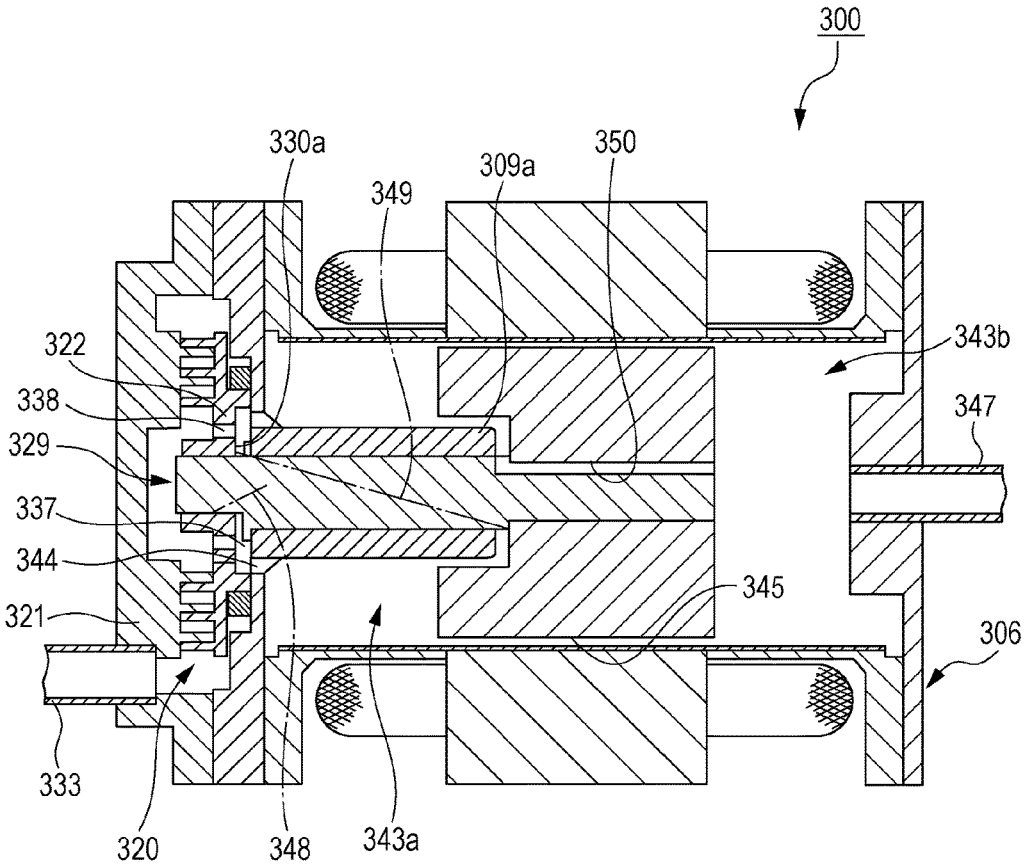
FIG. 7 is a cross-sectional view illustrating a conventional canned refrigerant pump.
Figure 8:
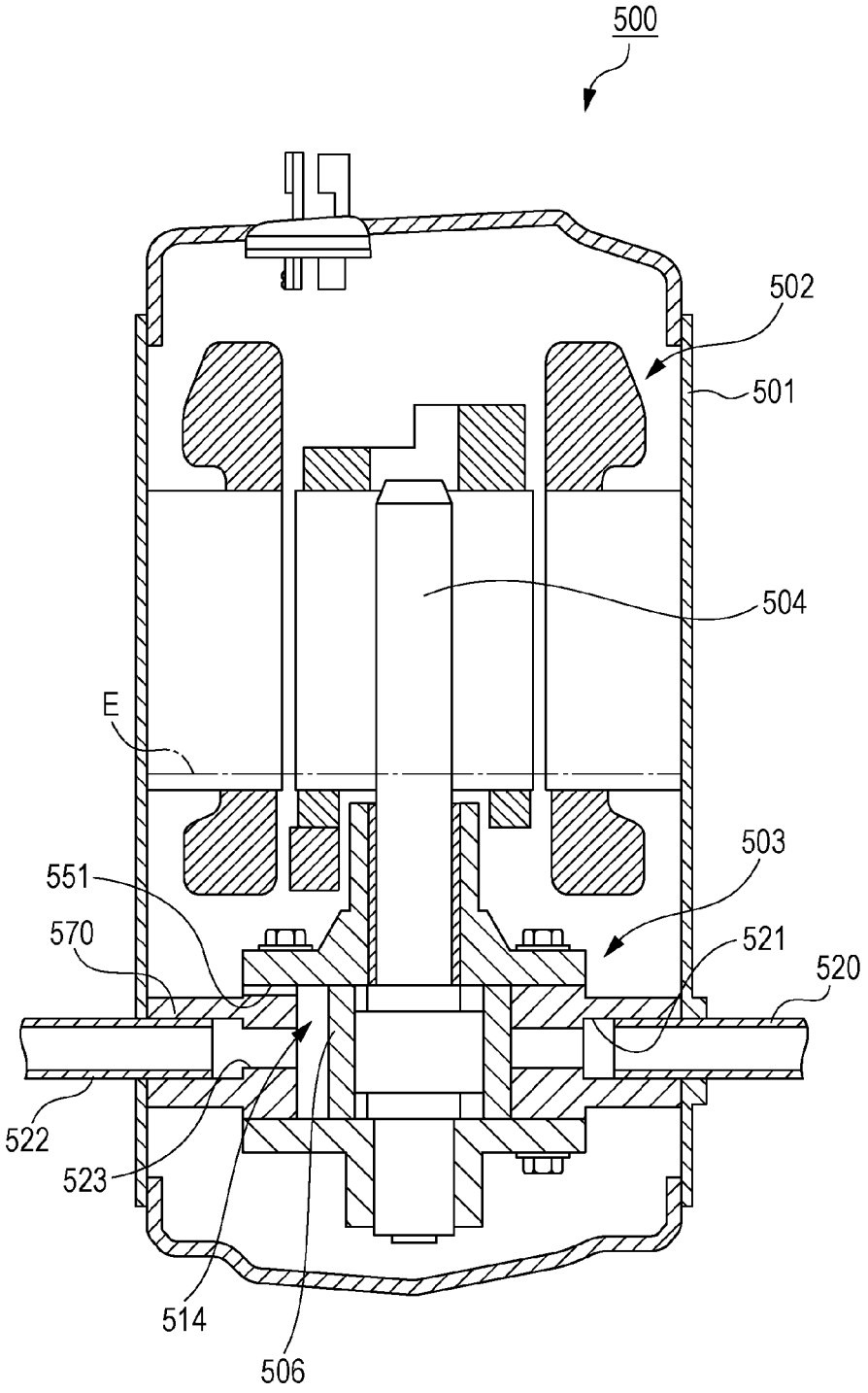
FIG. 8 is a cross-sectional view illustrating a conventional liquid refrigerant pump.

The liquid pump 1*a* may be modified as a liquid pump 1*c* illustrated in FIG. 6. As illustrated in FIG. 6, the liquid pump 1*c* includes a discharge pipe 13*a* instead of the discharge pipe 13. The discharge pipe 13*a* is attached to the wall of the container 10. An end of the discharge pipe 13*a* is directly connected to the pump mechanism 20. In other words, an internal space of the discharge pipe 13*a* is in direct communication with the internal space of the outlet hole 22*a*. This configuration enables the liquid that has expelled from the outlet hole 22*a* to be discharged to the outside of the liquid pump 1*c* through the discharge pipe 13*a* without being stored in a space having the predetermined capacity.

The upper bearing member 22 has a communication hole 22*b* positioned radially outward from the pump case 23. The communication hole 22*b* extends through the upper bearing member 22. The space positioned above the upper bearing member 22 and the space positioned below the upper bearing member 22 are in communication with each other through the communication hole 22*b* and form the inlet storage space 51. In such a case, the inner surface of the container 10, for example, defines only the inlet storage space 51. The liquid to be taken into the pump mechanism 20 is stored not only in the space of the inlet storage space 51 positioned below the upper bearing member 22 but also in the space of the inlet storage space 51 positioned above the upper bearing member 22. Since the inlet storage space 51 has the predetermined capacity, the pressure pulsation, which may be caused by the liquid flowing from and into the inlet storage space 51, is reduced. In addition, since the inlet of the liquid supply passage 60 is open to the inlet storage space 51, the liquid having reduced pressure variation is supplied to the bearing 40. As a result, the pressure variation in the liquid is reduced in the bearing 40, and cavitation is unlikely to occur.

In the liquid pump 1*c*, the liquid supply passage 60 includes two inlet liquid supply passages 61. One of the inlet liquid supply passages 61 is a flow path through which the liquid stored in the space of the inlet storage space 51 positioned below the upper bearing member 22 is supplied to the first bearing 41, and the other is a flow path through which the liquid stored in the space of the inlet storage space 51 positioned above the upper bearing member 22 is supplied to the second bearing 43.

What is claimed is:

1. A liquid pump comprising:

a container;

a shaft disposed in the container;

a bearing supporting the shaft;

a pump mechanism disposed in the container to pump a liquid by rotation of the shaft;

a storage space defined in the container at a position outside the pump mechanism, the storage space storing the liquid to be taken into the pump mechanism or the liquid to be discharged to outside of the container after being expelled from the pump mechanism; and a liquid supply passage including an inlet open to the storage space and supplying at least some of the liquid stored in the storage space to the bearing, wherein the storage space includes an inlet storage space for storing the liquid to be taken into the pump mechanism and an outlet storage space for storing the liquid to be discharged to the outside of the container after being expelled from the pump mechanism, wherein the bearing includes a first bearing and a second bearing supporting the shaft at different positions in an axial direction of the shaft, and the liquid supply passage has an inlet liquid supply passage supplying at least some of the liquid stored in the inlet storage space to the first bearing and an outlet liquid supply passage supplying at least some of the liquid stored in the outlet storage space to the second bearing.

2. The liquid pump according to claim 1, wherein the shaft has the liquid supply passage inside of the shaft.

3. The liquid pump according to claim 1, further comprising a pressure boost mechanism that increases a pressure of the liquid to be supplied to the bearing through the liquid supply passage.

4. The liquid pump according to claim 3, wherein the pressure boost mechanism includes a flow path extending in the shaft in a radial direction of the shaft.

5. The liquid pump according to claim 1, wherein the shaft has at least one end open facing to the storage space.

6. The liquid pump according to claim 1, further comprising a motor disposed in the storage space and fixed to the shaft.

7. A rankine cycle apparatus comprising:

a liquid pump;

a heater that heats a working fluid;

an expander that expands the working fluid heated by the heater; and a radiator that releases heat of the working fluid expanded by the expander, the liquid pump taking in as the liquid the working fluid flowing from the radiator in liquid state by using the pump mechanism and pumping out the liquid to the heater, wherein the liquid pump includes:

a container;

a shaft disposed in the container;

a bearing supporting the shaft;

a pump mechanism disposed in the container to pump a liquid by rotation of the shaft;

a storage space defined in the container at a position outside the pump mechanism, the storage space storing the liquid to be taken into the pump mechanism or the liquid to be discharged to outside of the container after being expelled from the pump mechanism; and a liquid supply passage including an inlet open facing to the storage space and supplying at least some of the liquid stored in the storage to the bearing, wherein the storage space includes an inlet storage space for storing the liquid to be taken into the pump mechanism and an outlet storage space for storing the liquid to be discharged to the outside of the container after being expelled from the pump mechanism, wherein the bearing includes a first bearing and a second bearing supporting the shaft at different positions in an axial direction of the shaft, and the liquid supply passage has an inlet liquid supply passage supplying at least some of the liquid stored in the inlet storage space to the first bearing and an outlet liquid supply passage supplying at least some of the liquid stored in the outlet storage space to the second bearing.

* * * * *